US006827055B2

(12) United States Patent
Tsunoda et al.

(10) Patent No.: US 6,827,055 B2
(45) Date of Patent: Dec. 7, 2004

(54) RECOIL STARTER OF FORCE ACCUMULATION TYPE

(75) Inventors: Shuhei Tsunoda, Tokyo (JP); Taro Kihara, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 10/787,654

(22) Filed: Feb. 26, 2004

(65) Prior Publication Data

US 2004/0168668 A1 Sep. 2, 2004

(30) Foreign Application Priority Data

Feb. 28, 2003 (JP) ..... 2003-054539

(51) Int. Cl.[7] ..... F02N 3/02; F02N 5/02
(52) U.S. Cl. ..... 123/185.14; 123/185.3
(58) Field of Search ..... 123/185.14, 185.3

(56) References Cited

U.S. PATENT DOCUMENTS 887,087 A * 5/1908 Coleman et al. ..... 337/392
1,217,762 A * 2/1917 Herzmark ..... 123/185.3
2,500,076 A * 3/1950 Honeyman ..... 74/140
3,306,277 A * 2/1967 Gudmundsen ..... 123/185.14
4,582,030 A * 4/1986 Reese ..... 123/185.3
5,163,392 A * 11/1992 Morishima et al. .... 123/179.25
5,287,832 A * 2/1994 Uhl ..... 123/185.3
5,537,966 A 7/1996 Ohnishi
5,564,378 A * 10/1996 Rodriguez ..... 123/185.3
6,325,036 B1 * 12/2001 Gracyalny et al. ..... 123/185.14
6,718,931 B2 4/2004 Morishige et al.
6,722,336 B2 4/2004 Nieda et al.
2001/0047786 A1 * 12/2001 Kawasaki et al. ..... 123/185.3
2003/0015162 A1 1/2003 Harada et al.
2004/0016311 A1 1/2004 Hashiba

FOREIGN PATENT DOCUMENTS

JP 07-174061 7/1995
JP 2003-307167 10/2003
JP 2003-343400 12/2003

* cited by examiner

*Primary Examiner*—Carl S. Miller
*Assistant Examiner*—Arnold Castro

(57) ABSTRACT

A recoil starter is disclosed which enables a rotational force to be accumulated in accumulating means with a light pulling force and the accumulated rotational force to start an engine through simple operations. A cam wheel is rotated using a rotational force which has been accumulated in the accumulating means by pulling a recoil rope. Retention means is operable to restrain or permit the rotation of the cam wheel. Release means operates the retention means to restrain the rotation of the cam wheel by pulling a handle attached to the recoil rope, and operates the retention means to permit the rotation of the cam wheel by fixing the handle in a main casing.

10 Claims, 7 Drawing Sheets

RECOIL STARTER OF FORCE ACCUMULATION TYPE

BACKGROUND OF THE INVENTION

1. Field of the Invention

The present invention relates to a recoil starter of a force accumulation type having rotational force accumulating means such as a spiral spring for accumulating a rotational force of a rope reel which is rotated by pulling a recoil rope, wherein the rotational force accumulated in the accumulating means is transmitted to a crankshaft of an engine to start the engine.

2. Description of the Related Art

A recoil starter of a force accumulation type is known in the art in which a rotational force is accumulated in accumulating means such as a spiral spring by pulling a recoil rope wound around a recoil reel. When the rotational force accumulated in the accumulating means exceeds the load of an engine, the rotational force accumulated in the accumulating means is released and transmitted to a crankshaft of the engine to start the engine. In such a conventional recoil starter of a force accumulation type, when the load of the engine at the engine starting is small, the rotational force accumulated in the accumulating means is released to the engine to rotate the crankshaft before a rotational force sufficient to start the engine has been accumulated. That is, a rotational speed sufficient for starting the engine cannot be obtained and the engine cannot be started with the accumulated rotational force. Therefore, it has been necessary to pull the recoil rope in association with the rotational force accumulated in the accumulating means.

A recoil starter of a force accumulation type has already been proposed in which a rotation of a cam resulting from accumulating means is obstructed until a sufficient rotational force has been accumulated in the accumulating means, wherein in this state, a recoil rope is pulled several times to rotate a rope reel several times so that a sufficient rotational force is accumulated in the accumulating means, and thereafter, the rotational force accumulated in the accumulating means is rapidly released to a crankshaft of the engine by operating an operational lever, so that the engine is started only by the rotational force accumulated in the accumulating means (see, e.g., Japanese Patent Application Laid-Open Publication No. 7-174061).

This conventional recoil starter is constructed so that a rotational force is accumulated in a spiral spring serving as the accumulating means by taking up the spiral spring around an outer peripheral surface of a drum that transmits rotation to the crankshaft of the engine via a centrifugal clutch mechanism. The drum is rotated in a direction opposite to an engine starting direction via a planetary reduction mechanism and a drive shaft rotated by pulling the rope while the drum is engaged with a lock mechanism that obstructs rotation in the engine starting direction, so that the rotational force is accumulated in the spiral spring. Thereafter, the locked state of the lock mechanism is released by operating release means which is separately formed, so that the drum is rapidly rotated by the rotational force accumulated in the spiral spring, whereby the crankshaft is rotated to start the engine.

In this conventional recoil starter, it is necessary to return the recoil rope and further operate the release means after the rotational force has been accumulated in the accumulating means by pulling the recoil rope. In a case where the accumulated rotational force is insufficient and the recoil rope is again pulled, it becomes necessary to again grip a handle of the recoil rope. In addition, since the rotational force remains accumulated in the accumulating means when the recoil starter is left as it stands after pulling the recoil rope, the engine is in danger of starting contrary to one's intention if one's hand accidentally touches the release means.

SUMMARY OF THE INVENTION

The present invention has been made in order to solve the problems of the above-described conventional recoil starters. Accordingly, it is an object of the present invention to provide a recoil starter which enables a rotational force to be accumulated in accumulating means by pulling a recoil rope with a light pulling force, wherein the rotational force accumulated in the accumulating means is released to an engine to start the engine by fixing a handle for pulling the recoil rope in a main casing.

In order to attain the above object, according to the present invention, there is provided a recoil starter of a force accumulation type. The recoil starter comprises: a main casing provided on an inner side thereof with a reel shaft; a rope reel having a recoil rope wound therearound and rotatably supported around the reel shaft; a recoil spiral spring for rotatingly urging the rope reel in a direction in which the recoil rope is taken up; a cam wheel, rotatably supported around the reel shaft, for transmitting rotation to a rotating member coupled to an engine; accumulating means, disposed between the rope reel and the cam wheel, for accumulating a rotational force due to the rotation of the rope reel, the cam wheel being. rotated by the accumulated rotational force so that the rotating member is rotated via a transmission mechanism; retention means operable to restrain or permit the rotation of the cam wheel; and release means which operates the retention means to restrain the rotation of the cam wheel by pulling a handle attached to an end of the recoil rope, to thereby allow the accumulating means to accumulate a rotational force, and which operates the retention means to permit the rotation of the cam wheel by fixing the handle in the main casing, to thereby allow the rotational force accumulated in the accumulating means to be released to the cam wheel.

In a preferred embodiment of the invention, the retention means comprises a stopper lever engageable with lock pawls formed on the cam wheel to restrain the rotation of the cam wheel, and the release means comprises a release lever that is operated by pulling the handle so that the release lever engages with the stopper lever to restrain the movement of the stopper lever.

In a preferred embodiment of the invention, the release lever includes an operating piece of which an end is disposed to correspond to a support portion for receiving the handle, which support portion is slidably disposed on the main casing, and the release lever is operated via the operating piece due to the handle being received in the support portion and fixed in the main casing, so that the stopper lever is operated to permit the rotation of the cam wheel.

In a preferred embodiment of the invention, the recoil starter further comprises a reduction mechanism in the form of a planetary gear mechanism, interposed between the rope reel and the accumulating means, for transmitting the rotation of the rope reel to the accumulating means at a reduced speed, to thereby reduce the pulling force of the recoil rope.

In a preferred embodiment of the invention, the transmission mechanism comprises a centrifugal ratchet mechanism which includes cam pawls formed on an outer peripheral surface of the cam wheel and centrifugal ratchets that are rotatably disposed on the rotating member disposed at the engine so as to disengageably engage with the cam pawls.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Figure 1:
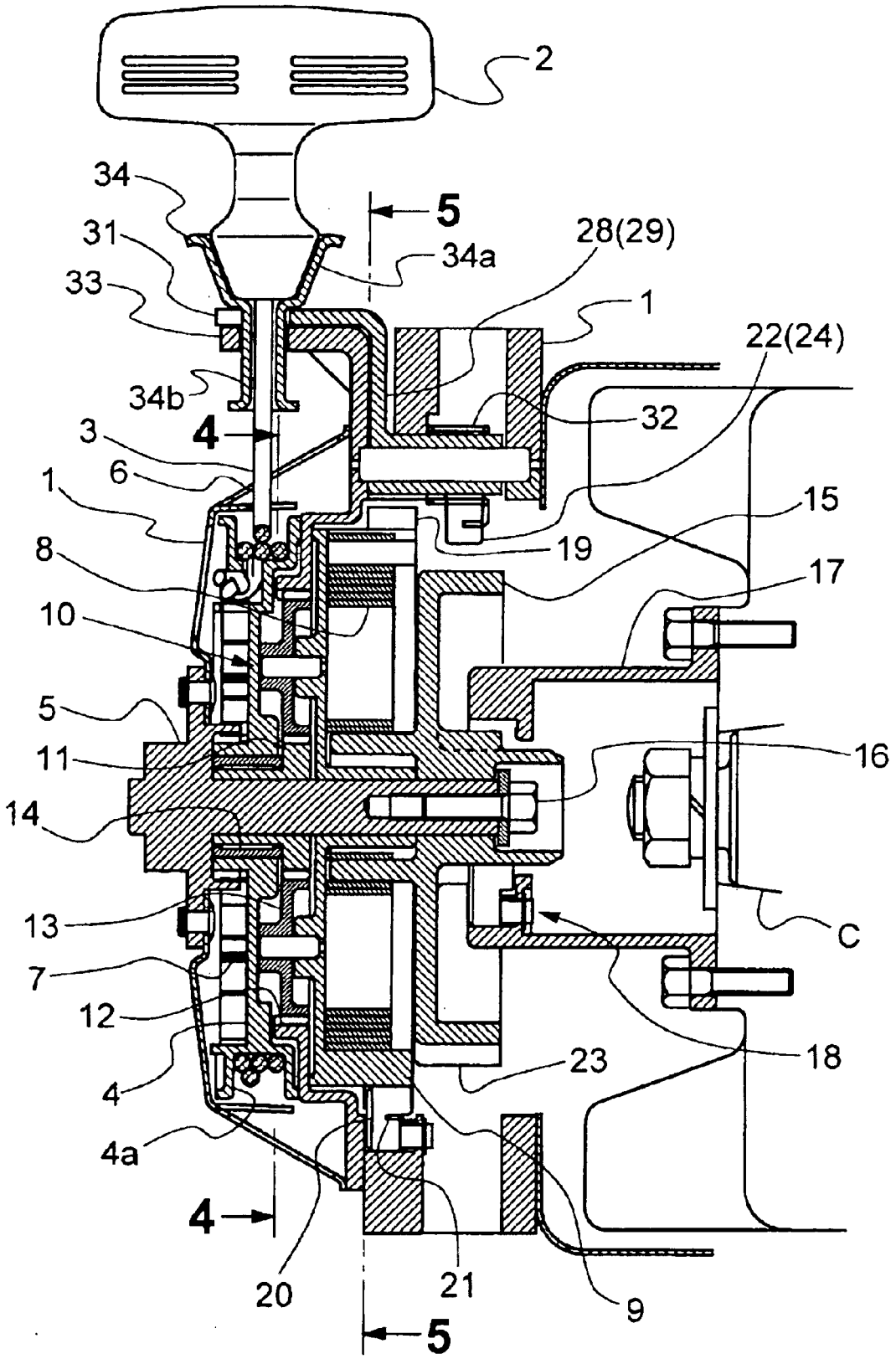
FIG. 1 is a sectional side elevation view showing a recoil starter of a force accumulation type according to an embodiment of the invention.
Figure 2:
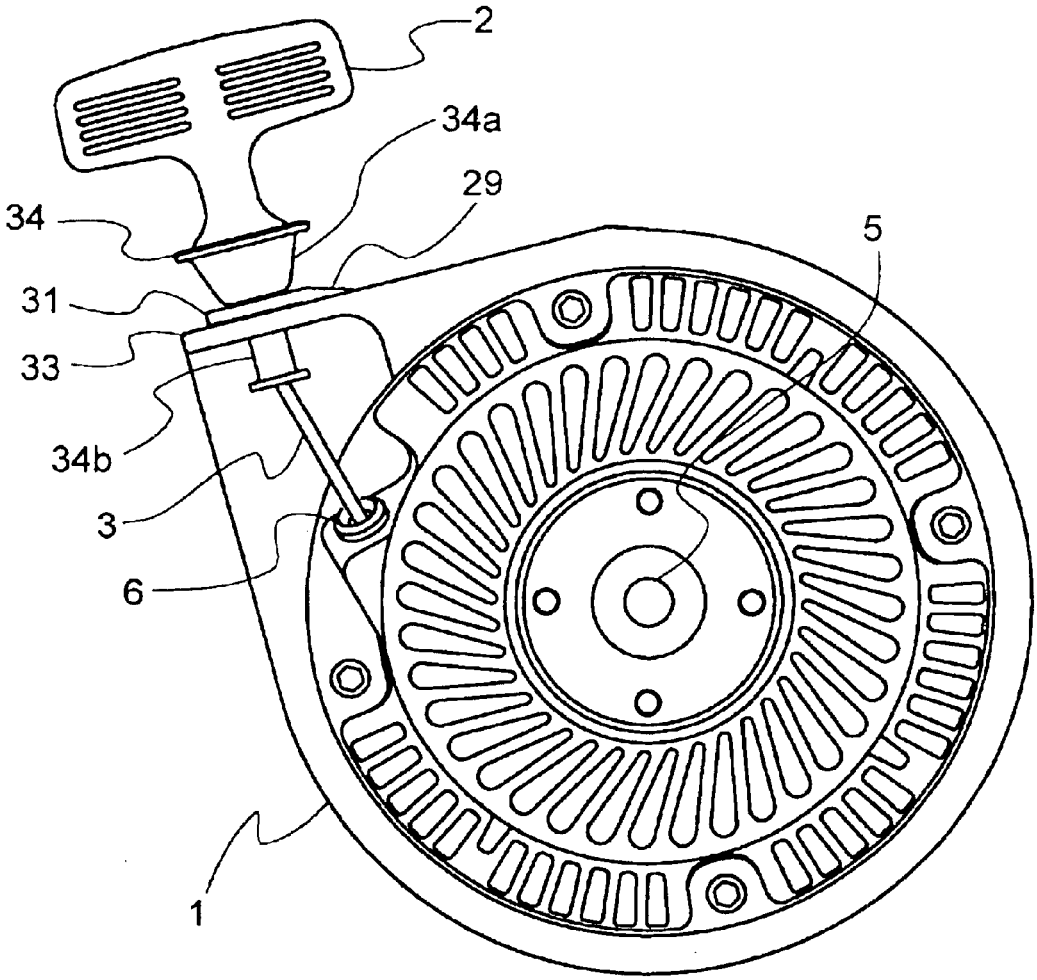
FIG. 2 is a front view of the recoil starter of a force accumulation type shown in FIG. 1.
Figure 3:
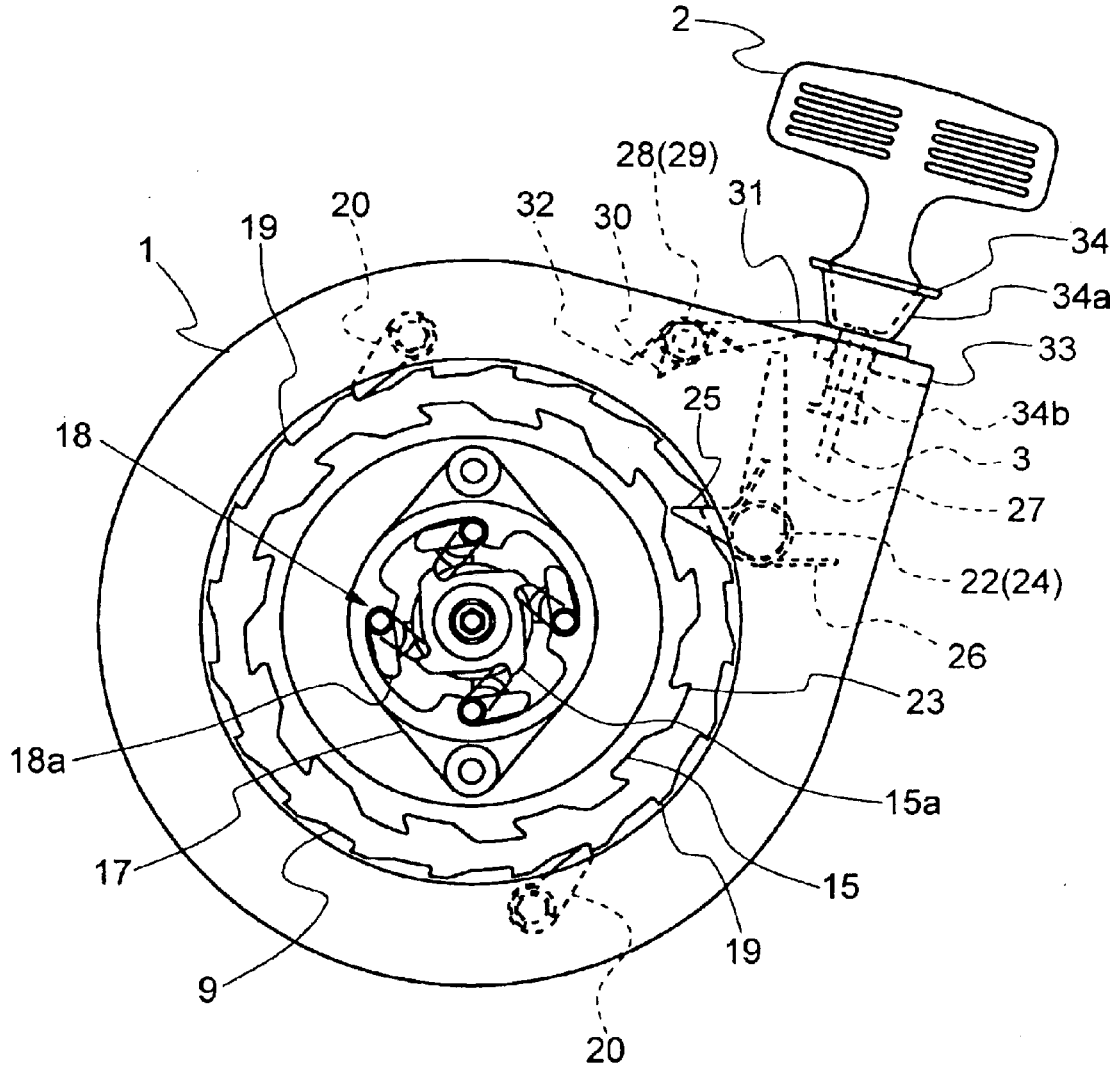
FIG. 3 is a rear view of the recoil starter of a force accumulation type shown in FIG. 1.
Figure 4:
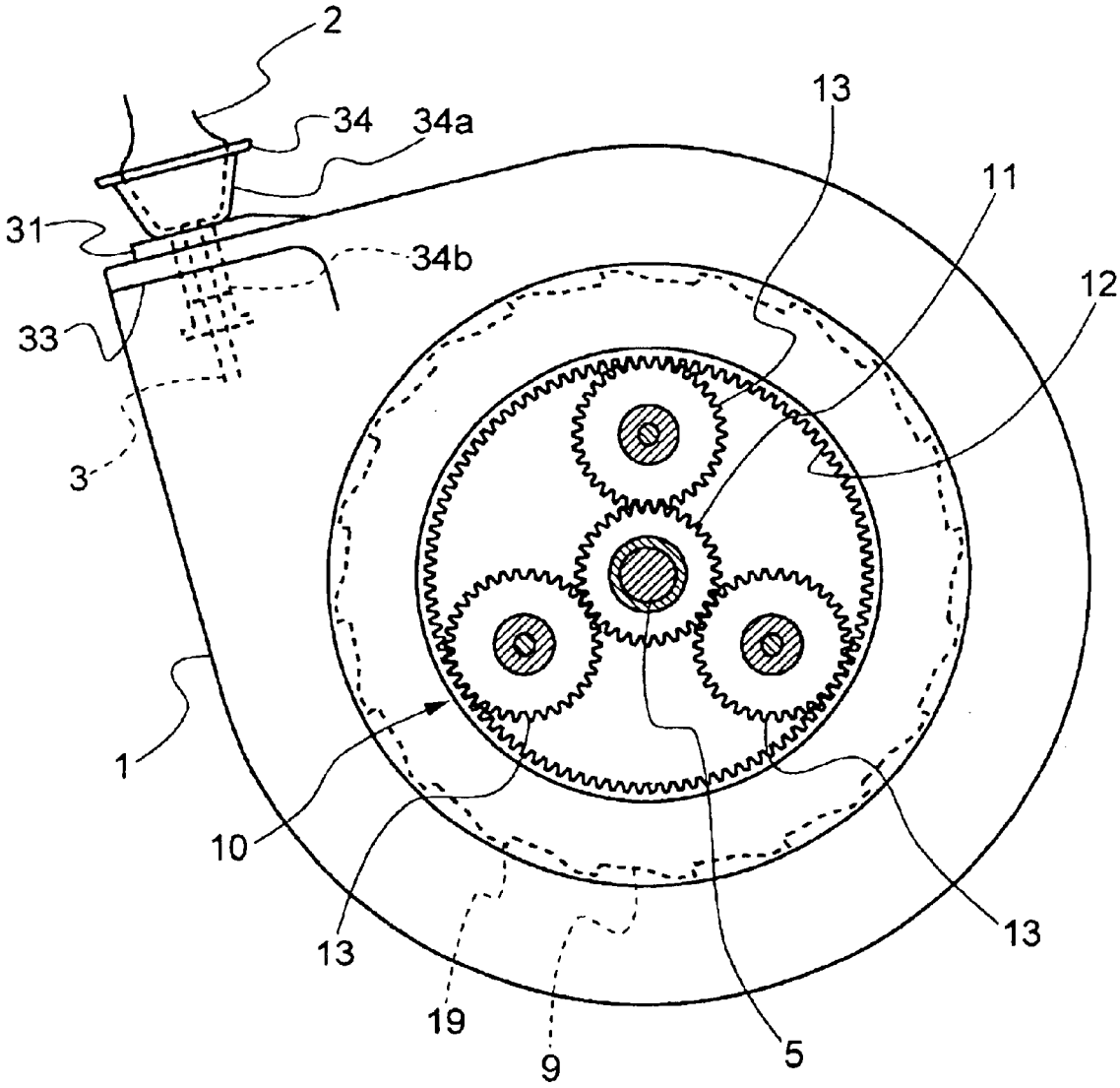
FIG. 4 is a cross-sectional view taken along line 4—4 of FIG. 1.
Figure 5:
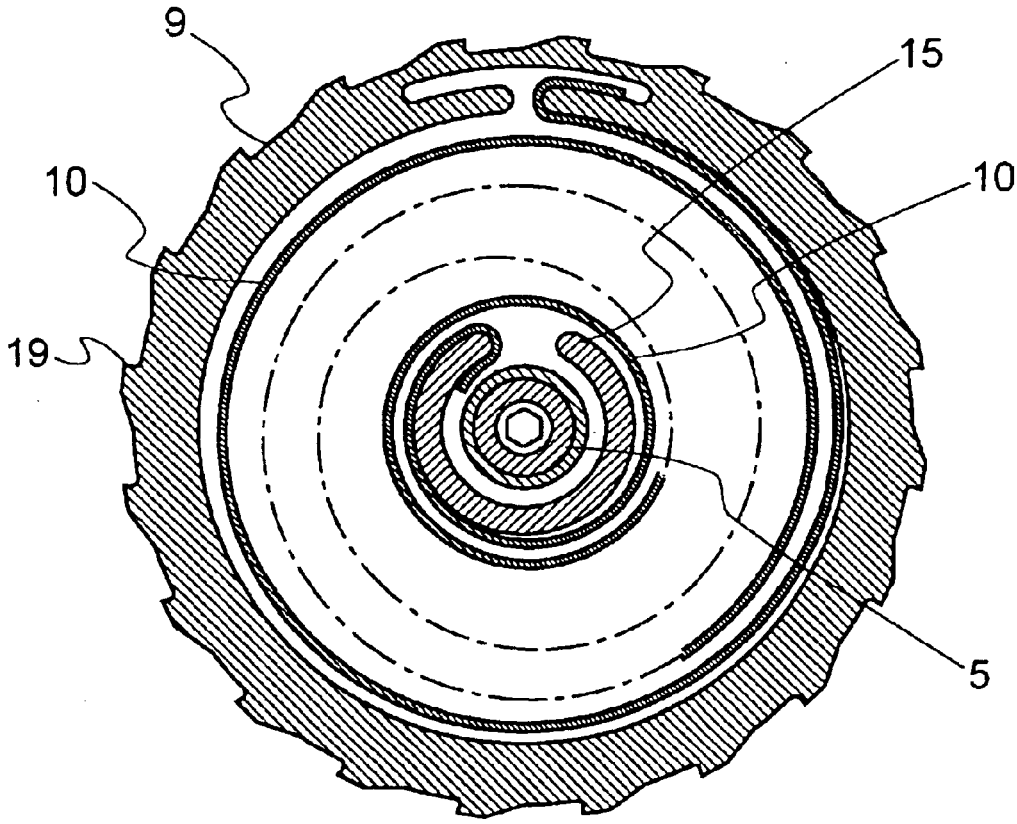
FIG. 5 is a cross-sectional view taken along line 5—5 of FIG. 1.

An embodiment of the invention will be described below with reference to the drawings. As shown in FIG. 1, a recoil starter of a force accumulation type according to the invention is configured so that, by pulling a handle 2 disposed so as to project outward from a main casing 1 housing main components, a recoil rope 3 fixed to the handle 2 is pulled to cause a rope reel 4 having the recoil rope 3 wound therearound to rotate. The rope reel 4 is rotatably mounted to a reel shaft 5 which is attached to part of the main casing 1 so as to coaxially face a crankshaft C of an engine. A drum portion 4*a* is formed at an outer periphery of the rope reel 4, and the recoil rope 3 is wound around the drum portion 4*a* of the rope reel 4 while an end thereof is fixed to the rope reel 4. As shown in FIG. 2, the other end of the recoil rope 3 is pulled outward from the main casing 1 through an opening 6 formed in the main casing 1 and attached to the handle 2. By pulling the handle 2, the recoil rope 3 is pulled out and the rope reel 4 is rotated around the reel shaft 5.

A recoil spiral spring 7 is disposed between a side surface of the rope reel 4 and an inner wall surface of the main casing 1. The recoil spiral spring 7 is adapted to rotate, in the opposite direction, the rope reel 4 which has been rotated in an engine starting direction by pulling the recoil rope 3, to thereby rewind the recoil rope 3 pulled out from the drum portion 4*a* of the rope reel 4 around the rope reel 4. An inner peripheral end of the recoil spiral spring 7 is fixed to the reel shaft 5, and an outer peripheral end of the recoil spiral spring 7 is fixed to the rope reel 4. When the recoil rope 3 is pulled and the rope reel 4 is rotated, a rotational force is accumulated in the recoil spiral spring 7. By releasing the recoil rope 3 or loosening the pulling force on the recoil rope 3, the rope reel 4 is rotated in the opposite direction by the rotational force accumulated in the recoil spiral spring 7, whereby the recoil rope 3 pulled out to the outside of the main casing 1 is rewound around the rope reel 4.

A spring case 9, which accommodates accumulating means 8 that accumulates a rotational force of the rope reel 3, is rotatably supported on the reel shaft 5. The rotation of the rope reel 4 in the engine starting direction is transmitted to the spring case 9 via a reduction mechanism 10. The reduction mechanism 10 is configured by a planetary gear mechanism comprising a sun gear 11, which is rotatably attached to the reel shaft 5, and planet gears 13, which are disposed between an outer periphery of the sun gear 11 and an inner periphery of a ring gear or internal gear 12 formed in the main casing 1 and which are rotatably supported on the spring case 9. The rope reel 4 is coupled to the sun gear 11 of the reduction mechanism 10 via a one-way clutch 14. The one-way clutch 14 is configured so that when the recoil rope 3 is pulled to rotate the rope reel 4 in the engine starting direction, the rotation of the rope reel 4 is transmitted to the sun gear 11, and when the rope reel 4 is rotated in the opposite direction by the recoil spiral spring 7, the rotation is not transmitted to the sun gear 11. Due to the reduction mechanism 10, the spring case 9 is rotated by a light pulling force of the recoil rope 3.

Moreover, a cam wheel 15 that transmits the rotational force accumulated in the accumulating means 8 is rotatably attached to the reel shaft 5. The cam wheel 15 is held by a screw 16 screwed into an end of the reel shaft 5 so that the sun gear 11, the spring case 9 and the cam wheel 15 do not come off the reel shaft 5. The accumulating means 8 is configured by a spirally wound spiral spring. The spiral spring 8 is received inside a recess formed in a side wall of the spring case 9. An outer peripheral end of the spiral spring 8 is fixed to the spring case 9, and an inner peripheral end of the spiral spring 8 is engaged with the cam wheel 15. Thus, the rotational force is accumulated in the spiral spring 8 by the rotation of the rope reel 4 in the engine starting direction, and the cam wheel 15 is rotated in the engine starting direction by the rotational force accumulated in the spiral spring 8.

In a state where the main casing 1 is attached to the engine, the cam wheel 15 is disposed so as to face a rotating member 17 attached to the crankshaft C of the engine. A transmission mechanism 18 for transmitting the rotation of the cam wheel 15 in the engine starting direction to the rotating member 17 is provided between the cam wheel 15 and the rotating member 17. The transmission mechanism 18 in the illustrated embodiment is configured by a plurality of cam pawls 15*a* formed on an outer peripheral surface of the cam wheel 15 along a circumferential direction thereof and centrifugal ratchets 18*a* disposed on the rotating member 17 that are caused to engage with and disengage from the cam pawls 15*a* by centrifugal force. When the cam wheel 15 is rotated in the engine starting direction, the centrifugal ratchets 18*a* engage with the cam pawls 15*a* to cause the rotating member 17 to rotate in the engine starting direction. When the engine starts and the rotating member 17 is rotated via the crankshaft C, the centrifugal ratchets 18*a* are each turned by centrifugal force counter to an urging force of a spring and disengage from the cam pawls 15*a* so that the rotation from the engine is not transmitted to the recoil starter.

A plurality of lock pawls 19 facing a direction opposite to the engine starting direction are formed along a circumferential direction on an outer peripheral surface of the spring case 9. Ratchets 20 are rotatably disposed in the main casing 1 so as to engage with the lock pawls 19, whereby rotation of the spring case 9 in the opposite direction is obstructed. The ratchets 20 are constantly and elastically urged in a direction in which they engage with the lock pawls 19. Thus, when the rope reel 4 is rotated in the engine starting direction, the spring case 9 is rotated via the reduction mechanism 10 in the engine starting direction to wind up the spiral spring 8, so that the rotational force of the rope reel 4 is accumulated in the spiral spring 8 while the spring case 9 is prevented from being rotated in the direction opposite to the engine starting direction by the rotational force accumulated in the spiral spring 8.

Retention means 22 is provided between the cam wheel 15 and the main casing 1 so that when a rotational force is accumulated in the spiral spring 8 by pulling the recoil rope 3, the retention means 22 prevents the cam wheel 15 from being rotated in the engine starting direction by the rotational force accumulated in the spiral spring B. The retention means 22 is configured by lock pawls 23 formed on the outer peripheral surface of the cam wheel 15 and a stopper lever 24 that is pivotally disposed in the main casing 1 and engages with one of the lock pawls 23 to restrain the rotation of the cam wheel 15. A stopper piece 25 formed on the stopper lever 24 engages with an engagement surface of one of the lock pawls 23 that faces the engine starting direction, whereby the rotation of the cam wheel 15 in the engine starting direction is obstructed. The stopper lever 24 is pivotally moved between a first position where the stopper piece 25 thereof engages with one of the lock pawls 23 and a second position where the stopper piece 25 thereof is separated from the lock pawls 23. The stopper lever 24 is urged by a spring 26 towards the first position at which the stopper piece 25 thereof engages with one of the lock pawls 23, so that the stopper lever 24 is ordinarily disposed at the first position where the stopper piece 25 thereof engages with one of the lock pawls 23.

The stopper lever 24 includes an operational piece 27 which is integrally formed with the stopper piece 25. Release means 28, which engages with an end of the operational piece 27 to retain the stopper lever 24 at the first position where the stopper piece 25 of the stopper lever 24 engages with one of the lock pawls 23 and which disengages from the end of the operational piece 27 to allow the stopper piece 25 of the stopper lever 24 to abut against the lock pawls 23 so that the stopper lever 24 pivots, is provided in the main casing 1. The release means 28 is configured by a release lever 29 that is pivotally supported on the main casing 1. An engagement protrusion 30 that is engageable with the operational piece 27 of the stopper lever 24 and an operating piece 31 that extends towards a portion where the handle 2 attached to the end of the recoil rope 3 is housed in the main casing 1 are integrally formed on the release lever 29. The release lever 29 is pivotally urged by a spring 32 in a direction in which the engagement protrusion 30 engages with the operational piece 27 of the stopper lever 24, so that the release lever 29 retains the stopper lever 24 at the first position where the stopper piece 25 of the stopper lever 24 engages with one of the lock pawls 23 of the cam wheel 15.

As shown in FIG. 2, the recoil rope 3 wound around the rope reel 4 is pulled to the outside of the main casing 1 through the opening 6 formed in the main casing 1. The recoil rope 3 is passed through a guide sleeve 34 retained at a support portion 33 formed on the main casing 1, and the handle 2 is attached to the end of the recoil rope 3. The guide sleeve 34 includes an upper cup-shaped portion 34*a* that is so formed that a lower portion of the handle 2 can be received therein and a lower cylindrical portion 34*b* that is slidably supported by the support portion 33 of the main casing 1. In a state where the recoil starter is not being operated, the recoil rope 3 is wound around the drum portion 4*a* of the rope reel 4 and drawn inside the main casing 1 by the rotational force of the recoil spiral spring 7 while a lower surface of the cup-shaped portion 34*a* of the guide sleeve 34 is caused to abut against an upper surface of the support portion 33 in a state where the lower portion of the handle 2 is received in the cup-shaped portion 34*a* of the guide sleeve 34.

An end portion of the operating piece 31 of the release lever 29 is interposed between the lower surface of the cup-shaped portion 34*a* of the guide sleeve 34 and the support portion 33 formed on the main casing 1. In a state where the recoil starter is not being operated, the recoil rope 3 undergoes a winding force from the rope reel 4 so that the operating piece 31 is pushed against the upper surface of the support portion 33 via the guide sleeve 34, wherein the engagement protrusion 30 of the release lever 29 is separated from the operational piece 27 of the stopper lever 24 to maintain the stopper lever 24 in a state where the cam wheel 15 can be rotated. When the recoil rope 3 is pulled out from the rope reel 4 via the handle 2 in order to start the engine, the handle 2 is separated from the guide sleeve 34 to permit the guide sleeve 34 to slide, and the operating piece 31 pushes the guide sleeve 34 up due to the pivotal urging force of the spring 32 acting on the release lever 29, so that the engagement protrusion 30 of the release lever 29 is pivotally moved to the position where the engagement protrusion 30 engages with the operational piece 27 of the stopper lever 24. As a result, in a state where the stopper piece 25 of the stopper lever 24 is disposed in the position where the stopper piece 25 engages with one of the lock pawls 23 of the cam wheel 15, the rotation of the stopper lever 24 is obstructed, whereby the rotation of the cam wheel 15 is obstructed by the stopper piece 25.

Figure 6:
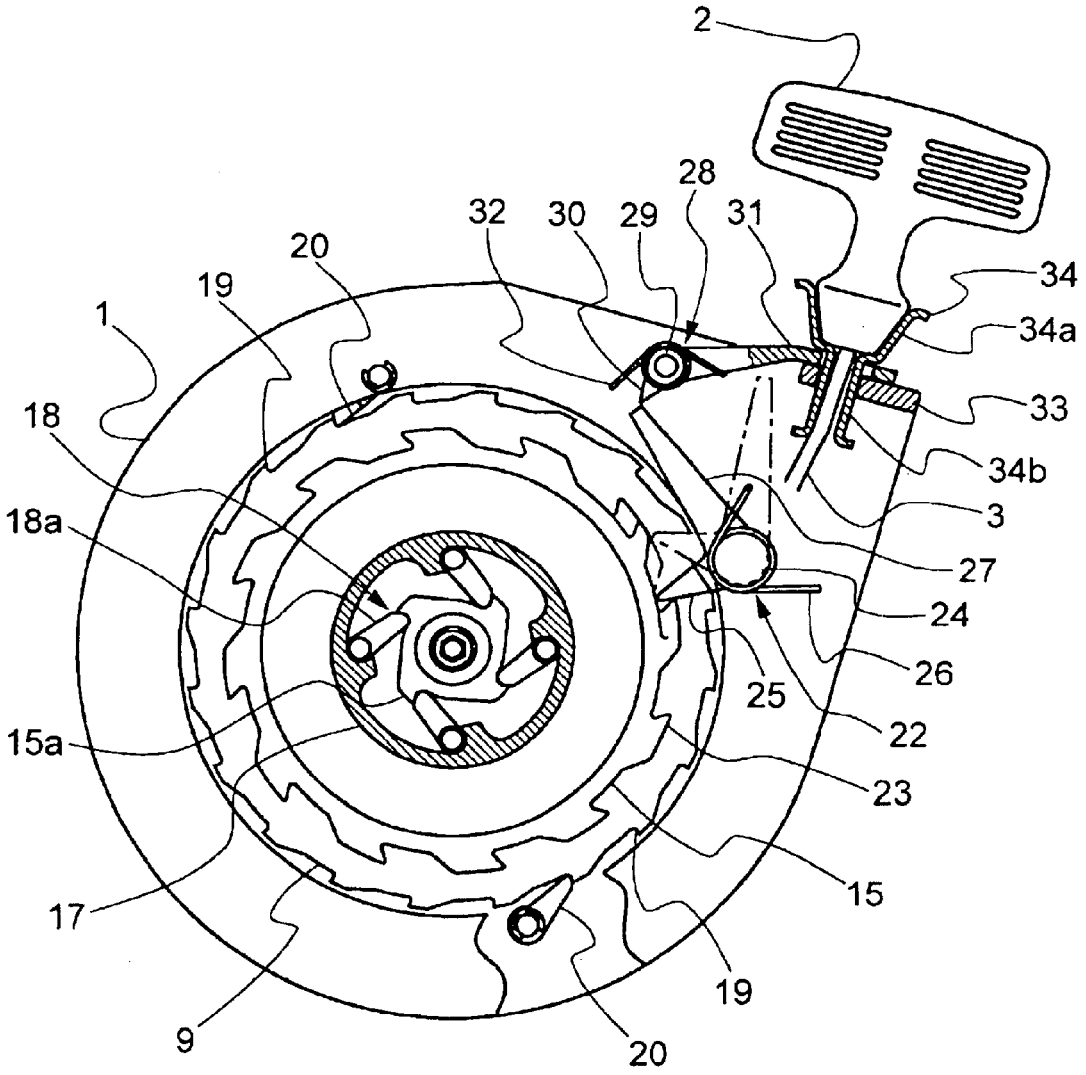
FIG. 6 is an explanatory diagram showing a state, prior to operation, of the recoil starter of a force accumulation type.

Next, the operation of the recoil starter of a force accumulation type according to the illustrated embodiment will be described. Prior to a starting operation of the engine, as shown in FIG. 6, the rope reel 4 has been rotated in the direction opposite to the engine starting direction by the action of the recoil spiral spring 7, and the recoil rope 3 is wound around the rope reel 4, wherein the recoil rope 3 is drawn inside the main casing 1 by the urging force of the recoil spiral spring 7, and the guide sleeve 34 is pushed towards the support portion 33 of the main casing 1 while the lower portion of the handle 2 is received inside the cup-shaped portion. 34*a* of the guide sleeve 34. The operating piece 31 of the release lever 29 is operated by the guide sleeve 34 to pivot so that the operating piece 31 pushes against the upper surface of the support portion 33, and the engagement protrusion 30 of the release lever 29 is pivotally moved to the position where the engagement protrusion 30 is separated from the operational piece 27 of the stopper lever 24, whereby the operational piece 27 of the stopper lever 24 is allowed to be pivotally moved and the cam wheel 15 can be rotated.

Figure 7:
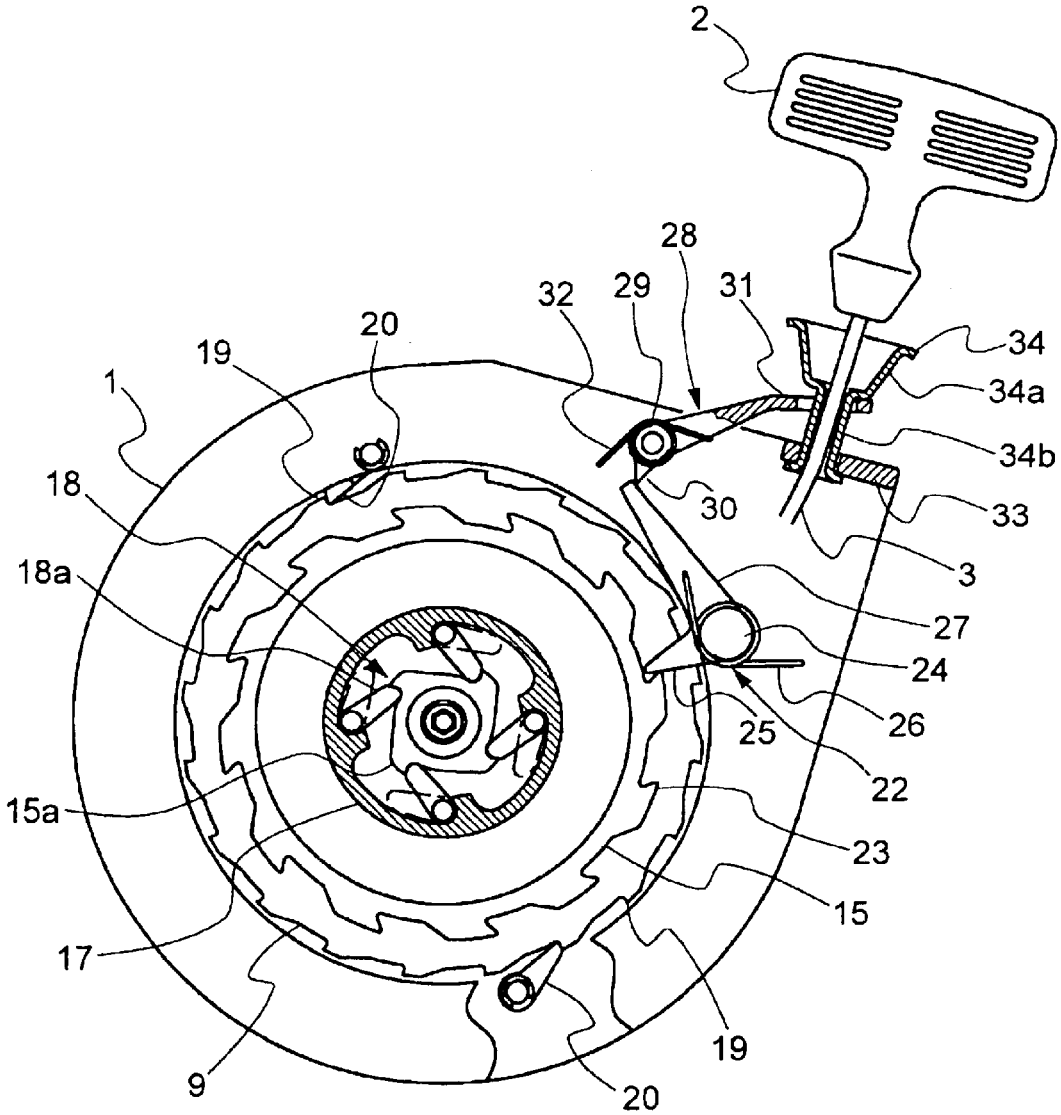
FIG. 7 is an explanatory diagram showing a state, during operation, of the recoil starter of a force accumulation type.

As shown in FIG. 7, by gripping the handle 2 and pulling out the recoil rope 3 in order to start the engine, the handle 2 is separated from the support portion 33 of the main casing 1, to thereby permit the guide sleeve 34 to slide. The operating piece 31 of the release lever 29 that has been pushed against the support portion 33 via the guide sleeve 34 is operated, by the urging force of the spring 32 pivotally urging the release level 29, to pivot and push up the guide sleeve 34, so that the engagement protrusion 30 is moved by pivoting of the release lever 29 to the position where the engagement protrusion 30 engages with the operational piece 27 of the stopper lever 24. The stopper piece 25 of the stopper lever 24 is disposed on a rotational locus of the lock pawls 23 of the cam wheel 15 by the action of the spring 26 while the engagement protrusion 30 of the release lever 29 engages with the operational piece 27 of the stopper lever 24 to obstruct the rotation of the stopper lever 24, whereby the stopper piece 25 of the stopper lever 24 cannot leave the rotational locus of the lock pawls 23 of the cam wheel 15, resulting in the rotation of the cam wheel 15 being obstructed.

When the rope reel 4 is rotated in the engine starting direction by pulling the handle 2, the spring case 9 is rotated via the reduction mechanism 10 constituted by the planetary gear mechanism and the rotational force is transmitted to the cam wheel 15 via the spiral spring 8. However, the rotation of the cam wheel 15 is obstructed by the lock pawls 23 of the cam wheel 15 engaging with the stopper piece 25, whereby the spring case 9 is rotated and the rotational force is accumulated in the spiral spring 8. When the pulling force of the handle 2 is loosened, the rope reel 4 is rotated in the opposite direction by the rotational force accumulated in the recoil spiral spring 7 and the recoil rope 3 is rewound around the rope reel 4. When the rope reel 4 is rotated in the opposite direction, the rotation of the rope reel 4 is not transmitted to the sun gear 11 of the reduction mechanism 10 due to the one-way clutch 14. Although the spring case 9 will be caused to rotate in the opposite direction by the rotational force accumulated in the spiral spring 8, the ratchets 20 engage with the lock pawls 19 formed on the outer periphery of the spring case 9, so that the rotation of the spring case 9 in the opposite direction is obstructed. In this manner, the rotational force is accumulated in the spiral spring 8 by repeatedly pulling the recoil rope 3. Since the rotation of the cam wheel 15 is obstructed during this time by the stopper lever 24 that is the retention means 22, the rotational force is not transmitted to the rotating member 17 coupled to the crankshaft C of the engine.

When the handle 2 is received in the cup-shaped portion 34*a* of the guide sleeve 34 and released after the rotational force has been sufficiently accumulated in the spiral spring 8 by repeatedly pulling the recoil rope 3, as shown in FIG. 6, the rope reel 4 is rotated in the opposite direction by the rotational force accumulated in the recoil spiral spring 7 so that the recoil rope 3 is rewound around the rope reel 4, whereby the guide sleeve 34 causes the operating piece 31 of the release lever 29 to pivot due to the pulling-in force of the recoil rope 3, and the engagement protrusion 30 is operated to pivot so that the engagement protrusion 30 separates from the operational piece 27 of the stopper lever 24. As a result, the stopper lever 24 is permitted to pivotally move so that the rotational force accumulated in the spiral spring 8 is released to the cam wheel 15, and the rotation of the cam wheel 15 is transmitted to the rotating member 17 via the transmission mechanism 18, with the result that the crankshaft C is rapidly rotated to start the engine. When the engine starts and the rotating member 17 is rotated via the crankshaft C, the centrifugal ratchets 18*a* of the transmission mechanism 18 are rotationally moved outward by the action of centrifugal force to disengage from the cam pawls 7*a* of the cam wheel 15, whereby the rotation of the engine is not transmitted to the cam wheel 15.

As described above, the recoil starter of a force accumulation type according to the invention is constructed so that the rotational force is accumulated in the accumulating means by the rotation of the rope reel, and the cam wheel is rotated by the accumulated rotational force so that the rotating member is rotated via the transmission mechanism, wherein the recoil starter is provided with the retention means operable to restrain or permit the rotation of the cam wheel, and the release means which operates the retention means to restrain the rotation of the cam wheel by pulling the handle attached to the recoil rope and which operates the retention means to permit the rotation of the cam wheel by fixing the handle in the main casing. According to such construction, regulation of the rotation of the cam wheel is automatically carried out while the handle is pulled in order to start the engine, and the rotation of the cam wheel can be allowed by returning the handle to the received position. Therefore, a special operation to retain or release the rotation of the cam wheel is not needed, and the engine starting operation can be easily conducted. In addition, since the cam wheel is placed in a freely rotatable state other than during the engine starting operation, the spiral spring is not left in a state where the rotational force is accumulated in the spiral spring, so that accidents resulting from a mistaken operation can be prevented.

In one embodiment of the invention, the retention means comprises the stopper lever engageable with the lock pawls formed on the cam wheel to restrain the rotation of the cam wheel, and the release means comprises the release lever that is operated by pulling the handle so that the release lever engages with the stopper lever to restrain the movement of the stopper lever. Thus, it is possible to retain or release the rotation of the cam wheel with a simple configuration resulting from two levers, resulting in the manufacturing cost of the recoil starter of a force accumulation type being prevented from increasing.

In one embodiment of the invention, the release means is provided on the release lever with the operating piece of which the end is disposed to correspond to the support portion for receiving the handle, which support portion is disposed on the main casing, wherein the release lever is operated via the operating piece due to the handle being received in the support portion, so that the stopper lever is operated to permit the rotation of the cam wheel. Therefore, such a simple construction enables the rotation of the cam wheel to be retained or permitted in conjunction with the operations of pulling the handle or fixing the handle in the support portion, resulting in the manufacturing cost of the recoil starter of a force accumulation type being prevented from increasing.

In one embodiment of the invention, the recoil starter of a force accumulation type further includes the reduction mechanism in the form of a planetary gear mechanism, interposed between the rope reel and the accumulating means, for transmitting the rotation of the rope reel to the accumulating means at a reduced speed. Therefore, it becomes possible to cause the accumulating means, which comprises the spiral spring of a strength sufficient to start the engine, to accumulate the rotational force with a small amount of labor even when the force with which the recoil rope is pulled is small while the handle is gripped, resulting in the engine starting operation being easily carried out.

In one embodiment of the invention, the transmission mechanism for transmitting the rotational force from the cam wheel to the rotating member comprises the centrifugal ratchet mechanism which includes the cam pawls formed on the outer peripheral surface of the cam wheel and the centrifugal ratchets that are rotatably disposed on the rotating member disposed at the engine so as to disengageably engage with the cam pawls. Therefore, the rotation of the cam wheel is reliably transmitted to the rotating member, and the rotational force can be prevented from being transmitted from the engine to the cam wheel after the engine has started.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A recoil starter of a force accumulation type comprising:

a main casing provided on an inner side thereof with a reel shaft;

a rope reel having a recoil rope wound therearound and rotatably supported around the reel shaft;

a recoil spiral spring for rotatingly urging the rope reel in a direction in which the recoil rope is taken up;

a cam wheel, rotatably supported around the reel shaft, for transmitting rotation to a rotating member coupled to an engine;

accumulating means, disposed between the rope reel and the cam wheel, for accumulating a rotational force due to the rotation of the rope reel, the cam wheel being rotated by the accumulated rotational force so that the rotating member is rotated via a transmission mechanism;

retention means operable to restrain or permit the rotation of the cam wheel; and release means which operates the retention means to restrain the rotation of the cam wheel by pulling a handle attached to an end of the recoil rope, to thereby allow the accumulating means to accumulate a rotational force, and which operates the retention means to permit the rotation of the cam wheel by fixing the handle in the main casing, to thereby allow the rotational force accumulated in the accumulating means to be released to the cam wheel.

2. The recoil starter according to claim 1, wherein the retention means comprises a stopper lever engageable with lock pawls formed on the cam wheel to restrain the rotation of the cam wheel, and wherein the release means comprises a release lever that is operated by pulling the handle so that the release lever engages with the stopper lever to restrain the movement of the stopper lever.

3. The recoil starter according to claim 2, wherein the release lever includes an operating piece of which an end is disposed to correspond to a support portion for receiving the handle, which support portion is slidably disposed on the main casing, and wherein the release lever is operated via the operating piece due to the handle being received in the support portion and fixed in the main casing, so that the stopper lever is operated to permit the rotation of the cam wheel.

4. The recoil starter according to claim 1, further comprising a reduction mechanism in the form of a planetary gear mechanism, interposed between the rope reel and the accumulating means, for transmitting the rotation of the rope reel to the accumulating means at a reduced speed, to thereby reduce the pulling force of the recoil rope.

5. The recoil starter according to claim 2, further comprising a reduction mechanism in the form of a planetary gear mechanism, interposed between the rope reel and the accumulating means, for transmitting the rotation of the rope reel to the accumulating means at a reduced speed, to thereby reduce the pulling force of the recoil rope.

6. The recoil starter according to claim 3, further comprising a reduction mechanism in the form of a planetary gear mechanism, interposed between the rope reel and the accumulating means, for transmitting the rotation of the rope reel to the accumulating means at a reduced speed, to thereby reduce the pulling force of the recoil rope.

7. The recoil starter according to claim 1, wherein the transmission mechanism comprises a centrifugal ratchet mechanism which includes cam pawls formed on an outer peripheral surface of the cam wheel and centrifugal ratchets that are rotatably disposed on the rotating member disposed at the engine so as to disengageably engage with the cam pawls.

8. The recoil starter according to claim 2, wherein the transmission mechanism comprises a centrifugal ratchet mechanism which includes cam pawls formed on an outer peripheral surface of the cam wheel and centrifugal ratchets that are rotatably disposed on the rotating member disposed at the engine so as to disengageably engage with the cam pawls.

9. The recoil starter according to claim 3, wherein the transmission mechanism comprises a centrifugal ratchet mechanism which includes cam pawls formed on an outer peripheral surface of the cam wheel and centrifugal ratchets that are rotatably disposed on the rotating member disposed at the engine so as to disengageably engage with the cam pawls.

10. The recoil starter according to claim 6, wherein the transmission mechanism comprises a centrifugal ratchet mechanism which includes cam pawls formed on an outer peripheral surface of the cam wheel and centrifugal ratchets that are rotatably disposed on the rotating member disposed at the engine so as to disengageably engage with the cam pawls.

* * * * *